US011767665B1

(12) United States Patent
Qin et al.

(10) Patent No.: US 11,767,665 B1
(45) Date of Patent: Sep. 26, 2023

(54) FOLDABLE AND FRAMED WALL ASSEMBLY

(71) Applicant: A&C Future, Inc., Newport Beach, CA (US)

(72) Inventors: Han Qin, Newport Beach, CA (US); Jiuqi Wang, Tustin, CA (US); Zhuangboyu Zhou, Santa Ana, CA (US); Sichen Li, Irvine, CA (US); Jiayang Qin, Newport Beach, CA (US)

(73) Assignee: A&C Future Inc, Newport Beach, CA (US)

( * ) Notice: Subject to any disclaimer, the term of this patent is extended or adjusted under 35 U.S.C. 154(b) by 12 days.

(21) Appl. No.: 17/740,325

(22) Filed: May 9, 2022

(51) Int. Cl.

| | |
|---|---|
| ***E04B 1/343*** | (2006.01) |
| ***E04B 2/56*** | (2006.01) |
| ***E04B 2/00*** | (2006.01) |
| ***E04C 2/34*** | (2006.01) |

(52) U.S. Cl.
CPC ..... *E04B 1/34357* (2013.01); *E04B 2/56* (2013.01); *E04C 2/34* (2013.01); *E04C 2/46* (2013.01); *E04C 2002/3488* (2013.01)

(58) Field of Classification Search
None
See application file for complete search history.

(56) References Cited

U.S. PATENT DOCUMENTS

| | | | | |
|---|---|---|---|---|
| 9,062,448 | B2 * | 6/2015 | Richardson | E04B 1/34357 |
| 9,909,314 | B2 * | 3/2018 | Jobin | E04C 3/08 |
| 2004/0231274 | A1 * | 11/2004 | Engstrom | E04B 2/767 52/634 |
| 2012/0110946 | A1 * | 5/2012 | Daas | B66C 23/70 52/646 |
| 2014/0157714 | A1 * | 6/2014 | Richardson | E04B 1/1903 52/646 |
| 2015/0101261 | A1 * | 4/2015 | Merrifield | E04B 1/34357 52/67 |

* cited by examiner

*Primary Examiner* — Joshua K Ihezie
(74) *Attorney, Agent, or Firm* — Fei Hung Yang

(57) ABSTRACT

The present invention provides a foldable and framed wall assembly comprising: a wall frame and at least one wall skin, the wall frame including an upper beam, a lower beam, at least one middle beam, and multiple short rods to connect the upper beam, the lower beam, and the middle beam together. In addition, the wall frame can be folded up for easy transportation and handling, and the wall skin has conventional building acoustic and thermal insulation material attached to the inside and a latch to connect with the frame and looks basically indistinguishable from normal wall skin after installation. Through those structure, the workers can quickly build a wall with strength not much different from a normal wall, while the foldable frame ensures that the wall can be prefabricated in advance in the factory, which can also significantly improve the transportation efficiency.

15 Claims, 11 Drawing Sheets

FOLDABLE AND FRAMED WALL ASSEMBLY

FIELD OF THE INVENTION

The present invention relates generally to a foldable and framed wall assembly, and more particularly, the present invention effectively improves the traditional wall building process by optimizing the construction process to shorten the wall building time. The present invention further comprises two different structural designs that can make the user possible to choose different designs of internal frames and wall skins according to the needs at the time of use.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In the housing industry, the process of building a home is tedious and time-consuming. The process of making the walls has been a big part of the whole process. Whether it is pouring with reinforced cement, nailing wooden studs followed by plasterboard, or building with bricks it can take a lot of time. This greatly increases the expenses of building a house. If the wall building time can be reduced, then the building expenses will be greatly reduced, so that more people can own their own houses.

Therefore, how to quickly and efficiently reduce the time for making walls when building a house is the main problem that the applicant wants to solve.

SUMMARY

In order to solve the problem above, the present invention redefines the way of building walls by improving the traditional method of building walls. Based on the linkage principle, an internal frame that can be folded was designed. The frame can be folded and unfolded in a fairly short period, and after unfolding, there is a corresponding retraction device to fix it. After the frame is unfolded, the wall is assembled by applying a special wall skin (containing a housing material for sound and heat insulation and fire protection). This process not only optimizes the traditional wall building process but also completes other processes such as exterior decoration at the same time, greatly reducing the building time. The factory's internal frame and wall skin are prefabricated, saving the construction site steps. The frame and siding are available in two different configurations to meet the needs of the walls in most cases.

It is therefore an object of the present invention to provide an interior frame and siding for building walls that can be mass-produced in a factory by a manufacturer.

It is another object of the present invention to provide a new way of processing house walls.

It is yet another object of the present invention to provide an improved traditional way of building houses, thereby increasing the efficiency of building houses.

It is another object of the present invention to provide a design that improves the sound and heat insulation of walls.

It is a further object of the present invention to provide a design that improves the way of installing siding.

To achieve the objects above, the present invention provides a foldable and framed wall assembly, comprising:

a wall frame, comprising:

an upper beam, bottom of which is provided with a plurality of upper groove groups, and each of the upper groove groups is provided with two first upper grooves and two second upper grooves, and adjacent sidewalls between the first upper grooves are opened to form a first upper sliding hole, and adjacent sidewalls between the second upper grooves are also opened to form a second upper sliding hole, and the first upper grooves are symmetrically arranged with the second upper grooves;

a lower beam, top of which is provided with a plurality of lower groove groups, and each of the lower groove groups is provided with two first lower grooves and two second lower grooves, and the first lower grooves are symmetrically arranged with the second lower grooves;

at least one middle beam, top of which is provided with a plurality of first middle groove groups, and each of the first middle groove groups is provided with two first middle grooves and two second middle grooves corresponding to the first upper grooves and the second upper grooves respectively, and the first middle grooves are symmetrically arranged with the second middle grooves; bottom of the middle beam is provided with a plurality of second middle groove groups, and each of the second middle groove groups is provided with two third middle grooves and two fourth middle grooves corresponding to the first lower grooves and the second lower grooves respectively, and adjacent sidewalls between the third middle grooves are opened to form a first middle sliding hole, and adjacent sidewalls between the fourth middle grooves are also opened to form a second middle sliding hole, and the third middle grooves are symmetrically arranged with the fourth middle grooves;

multiple pairs of first short rods, top ends of which are inserted into the first upper grooves and slide on the first upper sliding hole through a first sliding rod, and bottom ends of the pair of first short rods are connected with the first middle grooves through a first pivot, so that the bottom ends can rotate when the top ends slide;

multiple pairs of second short rods, top ends of which are inserted into the second upper grooves, and slide on the second upper sliding hole through a second sliding rod, and bottom ends of the pair of second short rods are connected with the second middle grooves through a second pivot, so that the bottom ends can rotate when the top ends slide;

multiple pairs of third short rods, top ends of which are inserted into the third middle grooves, and slide on the first middle sliding hole through a third sliding rod, and bottom ends of the pairs of third short rods are connected with the first lower grooves through a third pivot, so that the bottom ends can rotate when the top ends slide; and multiple pairs of fourth short rods, top ends of which are inserted into the fourth middle grooves, and slide on the second middle sliding hole through a fourth sliding rod, and bottom ends of the pairs of fourth short rods are connected with the second lower grooves through a fourth pivot, so that the bottom ends can rotate when the top ends slide; and at least one wall skin, which is detachably attached to the wall frame to fill up the space of the wall frame to form a complete wall;

wherein, when the wall skin is not connected with the wall frame, the top ends of the first short rods and the second short rods slide toward each other, and the bottom ends of the first short rods rotate clockwise relative to the first middle grooves, and the bottom ends of the second short rods rotate counterclockwise relative to the second middle grooves, so that the upper beam moves downward and overlaps on the middle beam; the top ends of the third short rods and the fourth short rods also slide toward each other, and the bottom ends of the third short rods rotate clockwise relative to the first lower grooves, and the bottom ends of the fourth short rods rotate counterclockwise relative to the second lower grooves, so that the middle beam moves downward and overlaps on the lower beam.

In another aspect, wherein, when the upper beam is overlapped on the middle beam, a portion of each of the first short rods is located in the first upper grooves, and the other portion is located in the first middle grooves, and a portion of each of the second short rods is located in the second upper grooves, and the other portion is located in the second middle grooves; when the middle beam is overlapped on the lower beam, a portion of each of the third short rods is located in the third middle grooves, and the other portion is located in the first lower grooves, and a portion of each of the fourth short rods is located in the fourth middle grooves, and the other portion is located in the second lower grooves.

In another aspect, wherein, when the amount of middle beams is over one, structure of the wall frame is that the upper beam is at the top, the lower beam is at the bottom, the middle beams are sandwiched in the middle, and the first short rods, the second short rods, the third short rods, and the fourth short rods connect the middle beams to each other in the manner of connecting the upper beam and the middle beam and the manner of connecting the middle beam and the lower beam.

In another aspect, wherein, in each of the upper groove groups, there is an upper fixing slot formed in inner top surfaces of the first upper grooves at one end away from the second upper grooves and inner top surfaces of the second upper grooves at one end away from the first upper grooves respectively for the first short rods, the second short rods, the first sliding rods, and the second sliding rods to be fixed in the upper fixing slots to avoid sliding when assembled into a complete wall.

In another aspect, wherein, in each of the second middle groove groups, there is a middle fixing slot formed in inner top surfaces of the third middle grooves at one end away from the fourth middle grooves and inner top surfaces of the fourth middle grooves at one end away from the third middle grooves respectively for the third short rods, the fourth short rods, the third sliding rods, and the fourth sliding rods to be fixed in the middle fixing slots to avoid sliding when assembled into a complete wall.

In another aspect, wherein, the wall skin is provided with a plurality of longitudinal grooves corresponding to the first short rods, the second short rods, the third short rods, and the fourth short rods; the wall skin is also provided with a plurality of transverse grooves corresponding to the upper beam, the lower beam, and the middle beams; the wall skin is provided with a plurality of fillers between the longitudinal grooves and the transverse grooves.

In another aspect, wherein, the wall skin is provided with a plurality of snaps, and the upper beam, the lower beam, and the middle beams are provided with a plurality of snap holes correspondingly.

Furthermore, the present invention further presents another embodiment for a foldable and framed wall assembly, comprising:

a wall frame, comprising:

an upper beam with an upper deep groove at bottom;

a lower beam, top of which is provided with a lower long groove, and a lower slider is slidably arranged in the lower long groove;

at least one middle beam, top of which is provided with a middle long groove, and a middle slider is slidably arranged in the middle long groove, and bottom of the middle beam is provided with a middle deep groove;

a plurality of upper short rods, top end of which is pivotally connected to the upper deep groove, and bottom end is pivotally connected to the middle slider, and the upper short rods are arranged at intervals; and a plurality of lower short rods, top end of which is pivotally connected to the middle deep groove, and bottom end is pivotally connected to the lower slider, and the lower short rods are arranged at intervals; and at least one wall skin, which is detachably attached to the wall frame to fill up the space of the wall frame to form a complete wall;

wherein, when the wall skin is not connected with the wall frame, top and bottom ends of the upper short rods, and top and bottom ends of the lower short rods are rotated respectively in opposite directions to drive the middle slider and the lower slider to move, so that the upper short rods and the lower short rods are gradually inclined, and then the upper beam and the middle beam are moved vertically downward and overlapped on the lower beam; at this time, the upper short rods and the lower short rods are respectively placed in the upper deep groove and the middle deep groove.

In another aspect of this second embodiment, wherein, when the amount of middle beams is over one, the upper short rods connect the upper beam with the middle beam adjacent to the upper beam, and the lower short rods connect the lower beam with the middle beam adjacent to the lower beam; the wall frame has a plurality of middle short rods, tops of the middle short rods are pivotally connected to the deep groove in any of the middle beam that is not adjacent to the lower beam, and bottom ends of the middle short rods are pivotally connected to the middle slider of the middle beam located below, and the middle short rods are arranged at intervals.

In another aspect of this second embodiment, wherein, the middle long groove and the lower long groove are each provided with two blocking grooves for movably placing a blocking member to block the sliding of the middle slider and the lower slider.

In another aspect of this second embodiment, wherein, bottom of the middle slider and the lower slider are provided with a limiting member.

In another aspect of this second embodiment, wherein, width of bottom of the limiting members is greater than that where the limiting members are connected to the middle slider and the lower slider.

In another aspect of this second embodiment, wherein, the upper short rods, the middle short rods, and the lower short rods are provided with a groove on one side so that the middle slider and the lower slider do not get caught when folded.

In another aspect of this second embodiment, wherein, the wall skin is provided with a plurality of longitudinal grooves corresponding to the upper short rods, the middle short rods and the lower short rods, and the wall skin is also provided with a plurality of transverse grooves corresponding to the upper beam, the lower beam, and the middle beams, and the wall skin is further provided with a plurality of fillers between the longitudinal grooves and the transverse grooves.

In another aspect of this second embodiment, wherein, top of the wall skin is provided with two protrusions for inserting into the upper deep groove and the middle deep groove so that the wall skin and the wall frame are combined with each other.

By the above-mentioned embodiments of two different designs, it can be found that those designs consist of two parts, the interior folding frame, and the exterior siding. The design should be compatible with the frame building process, where the walls are not used as load-bearing or shear walls after installation. Since it is not load-bearing, the material used to make the frame can vary from wood to aluminum and other materials as required. The whole structure is made up of several horizontal prefabricated pieces. Prefabricated pieces are composed. Two connection methods are described here but may not be limited to any one of them. However, it may not be limited to any particular method.

The internal structure of both designs is a linkage mechanism, divided into three different layers, top, middle, and bottom (where the middle layer can be repeated as many times as required), and the layers are connected using short rods. The first rod structure adopts the symmetric folding method, in which two groups of short rods are folded inward to the upper and lower layers into the reserved slots; the second rod structure adopts the sliding folding method, in which all short rods are connected to a long slider that can slide in the reserved slots, and when the upper layer moves upward, the slider in the lower layer is driven to move, thus completing the unfolding. The difference between the two designs is that the first method has a thicker wall thickness for use as an exterior wall, while the second is thinner. The first design allows the short rod to be pushed to the center of each layer to achieve the effect of locking after full extension; the second design requires a stopper (two per layer) to limit the rod's sliding. The design is suitable for frame house construction and is also compatible with wood-frame houses. The frame can be placed directly between two already installed columns and then can be unfolded without disturbing the structure of the columns.

The exterior siding also differs between the two designs. The first design has pre-determined snap openings in the frame for the walls, which can be assembled by simply pressing the walls onto the frame; the inside of the siding contains the house's acoustic and thermal insulation and fireproofing material. After the internal frame is unfolded, the siding is installed on both sides of the wall. In the second design, the wall skin is also equipped with the acoustic and thermal insulation and fireproofing material of the house, and the sliding slots inside the frame can be stuck to the raised part of the wall skin after unfolding, thus completing the installation of the wall. Like the first design, this design also requires the installation of wall coverings on both sides of the wall.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1:
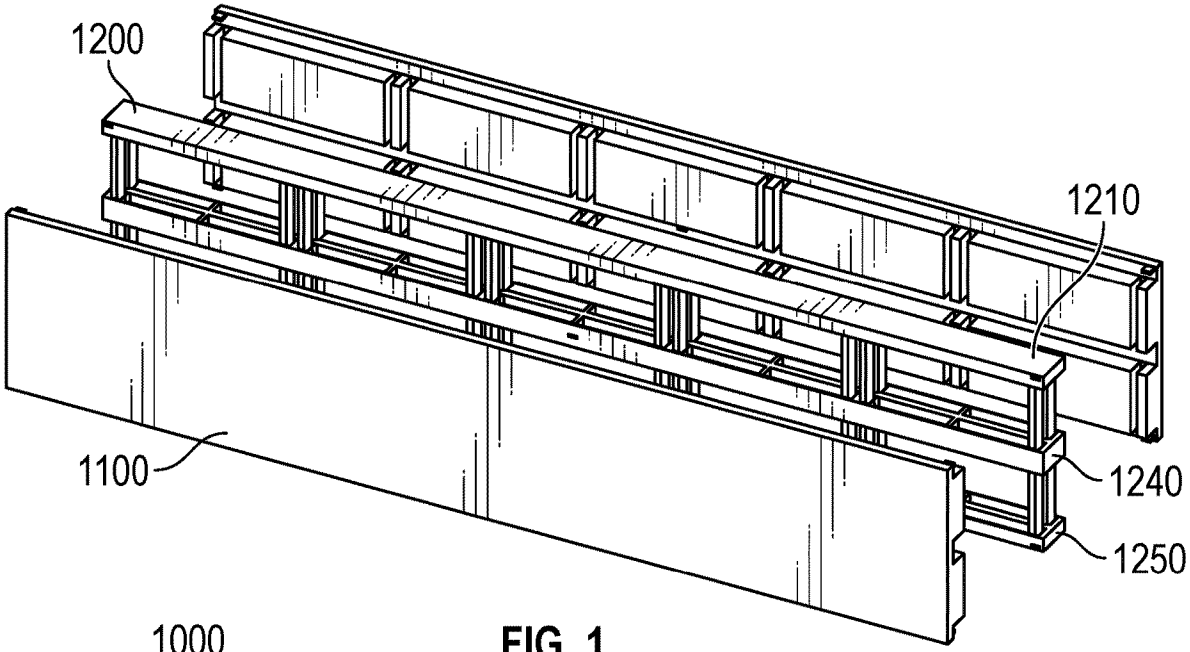
FIG. 1 illustrates the explosion view of a first embodiment of an assembled wall.
Figure 2:
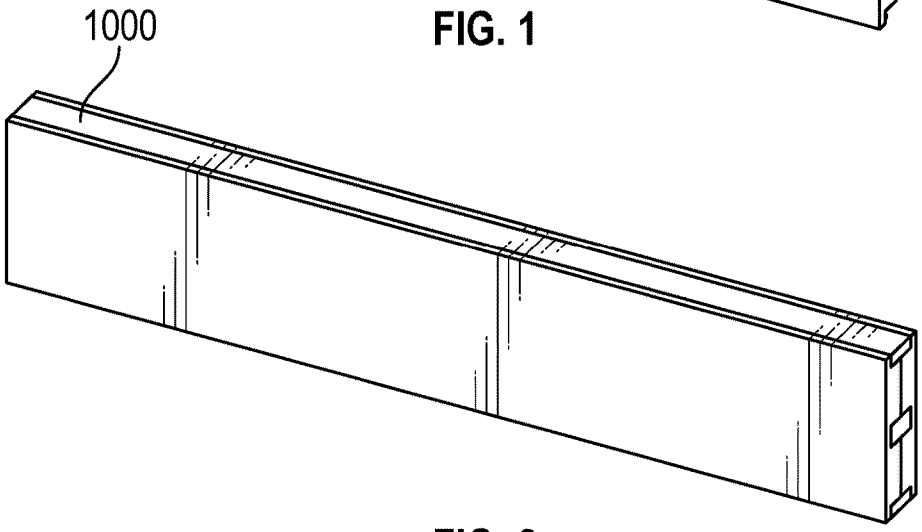
FIG. 2 illustrates the schematic view of the first embodiment of an assembled wall.

Please refer to FIGS. 1 & 2, they show the schematic view and exploded view of the first embodiment of the foldable and framed wall assembly 1000, which shows only a basic structure of the assembly 1000 (that is, structure for the upper beam 1210, middle beam 1240, lower beam 1250, which may be repeated for multiple middle beams 1240). In this first embodiment, both its front and back sides need to be attached to the wall skin 1100, and its interior is wall frame 1200. In other embodiments, the foldable and framed wall assembly 1000 may only have one wall skin 1100.

Figure 3:
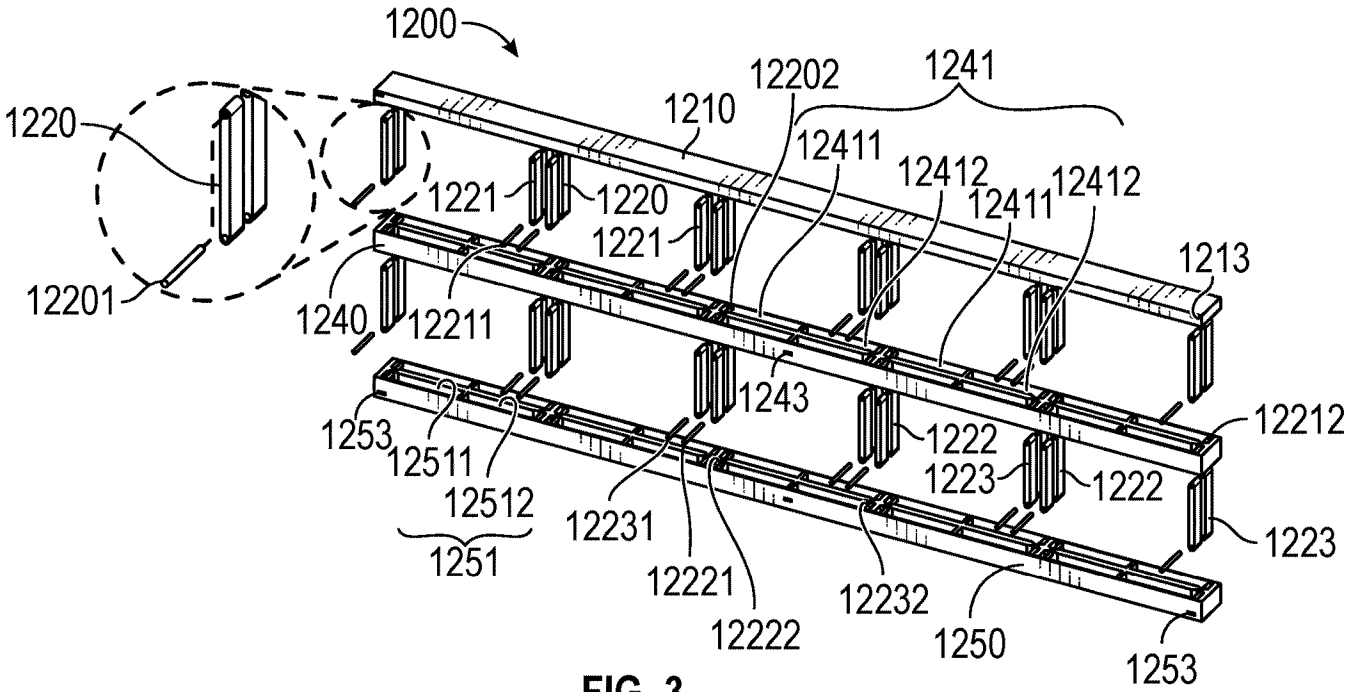
FIG. 3 shows the explosion view of the wall frame.
Figure 4:
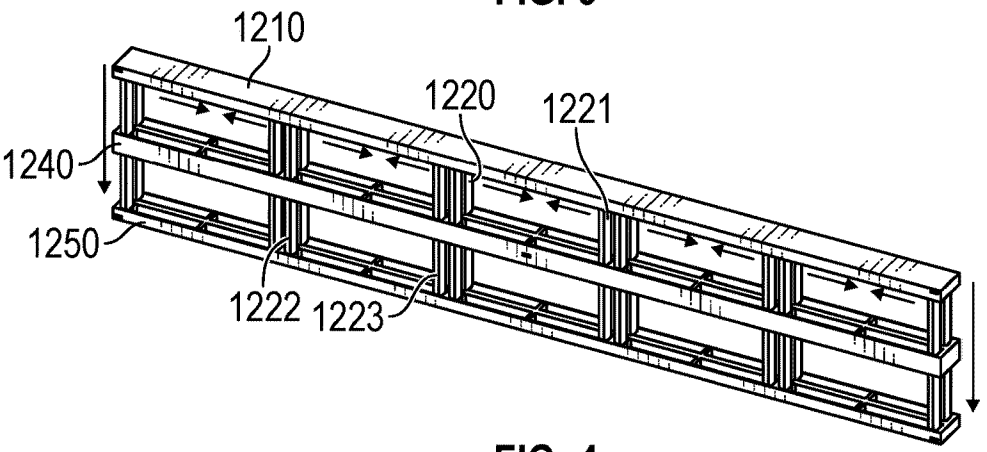
FIG. 4 shows the schematic view of the wall frame and how to collapse frame in the first embodiment.

Please refer to FIGS. 3 & 4, FIG. 3 shows the structure of the wall frame 1200 in the first embodiment. It consists of an upper beam 1210, multiple pairs of first short rods 1220, second short rods 1221, third short rods 1222, fourth short rods 1223, a middle beam 1240, and a lower beam 1250. In this embodiment, the first short rods 1220, the second short rods 1221, the third short rods 1222, and the fourth short rods 1223 are rounded rods with holes at both ends, and the upper part is connected to the lower part of the upper beam 1210 or the middle beam 1240; the lower part of those short rods is connected to the upper part of the middle beam 1240 or the lower beam 1250 by the bearing bolts 1230. In particular, the top ends of the first short rods 1220 are inserted into the first upper grooves 12111 and slide on the first upper sliding hole 12113 through a first sliding rod 12201, and bottom ends of the pair of first short rods 1220 are connected with the first middle grooves 12411 through a first pivot 12202, so that the bottom ends can rotate when the top ends slide. The top ends of the second short rods 1221 are inserted into the second upper grooves 12112, and slide on the second upper sliding hole 12114 through a second sliding rod 12211, and bottom ends of the pair of second short rods 1221 are connected with the second middle grooves 12412 through a second pivot 12212, so that the bottom ends can rotate when the top ends slide. The top ends of the third short rods 1222 are inserted into the third middle grooves 12421, and slide on the first middle sliding hole 12423 through a third sliding rod 12221, and bottom ends of the pairs of third short rods 1222 are connected with the first lower grooves 12511 through a third pivot 12222, so that the bottom ends can rotate when the top ends slide. The top ends of the fourth short rods 1223 are inserted into the fourth middle grooves 12422, and slide on the second middle sliding hole 12424 through a fourth sliding rod 12231, and bottom ends of the pairs of fourth short rods 1223 are connected with the second lower grooves 12512 through a fourth pivot 12232, so that the bottom ends can rotate when the top ends slide.

Furthermore, the upper beam 1210, the middle beam 1240, and the lower beam 1250 all have snap holes 1213, 1243, 1253 reserved for the wall skin 1100. FIG. 4 shows how the wall frame 1200 is folded, in the folding process, the top ends of the first short rods 1220 and the second short rods 1221 slide toward each other, and the bottom ends of the first short rods 1220 rotate clockwise relative to the first middle grooves 12411, and the bottom ends of the second short rods 1221 rotate counterclockwise relative to the second middle grooves 12412, so that the upper beam 1210 moves downward and overlaps on the middle beam 1240. In addition, the top ends of the third short rods 1222 and the fourth short rods 1223 also slide toward each other, and the bottom ends of the third short rods 1222 rotate clockwise relative to the first lower grooves 12511, and the bottom ends of the fourth short rods 1223 rotate counterclockwise relative to the second lower grooves 12512, so that the middle beam 1240 moves downward and overlaps on the lower beam 1250. In this way, the first short rods 1220 and the second short rods 1221 are folded relative to each other, and the third short rods 1222 and the fourth short rods 1223 are also folded relative to each other, so that the wall frame 1200 finally forms a folded state.

Figure 6:
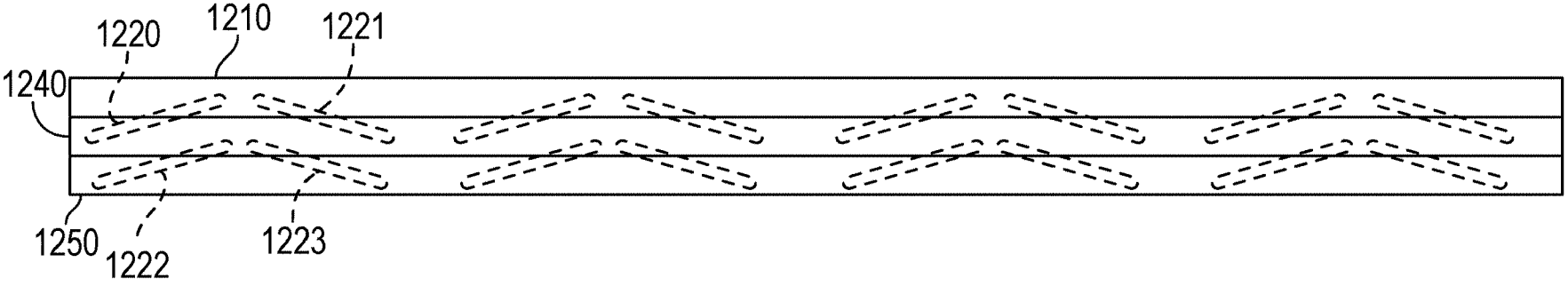
FIG. 6 shows a folding state of the short rods in the first embodiment.

Please also see FIG. 6, it is worth noting that when the upper beam 1210 is overlapped on the middle beam 1240, a portion of each of the first short rods 1220 is located in the first upper grooves 12111, and the other portion is located in the first middle grooves 12411, and a portion of each of the second short rods 1221 is located in the second upper grooves 12112, and the other portion is located in the second middle grooves 12412; when the middle beam 1240 is overlapped on the lower beam 1250, a portion of each of the third short rods 1222 is located in the third middle grooves 12421, and the other portion is located in the first lower grooves 12511, and a portion of each of the fourth short rods 1223 is located in the fourth middle grooves 12422, and the other portion is located in the second lower grooves 12512. Such an inclined arrangement allows the wall frame 1200 to be quickly re-stretched from the folded state to the fully expanded state, thereby reducing the time required for construction.

Figure 5:
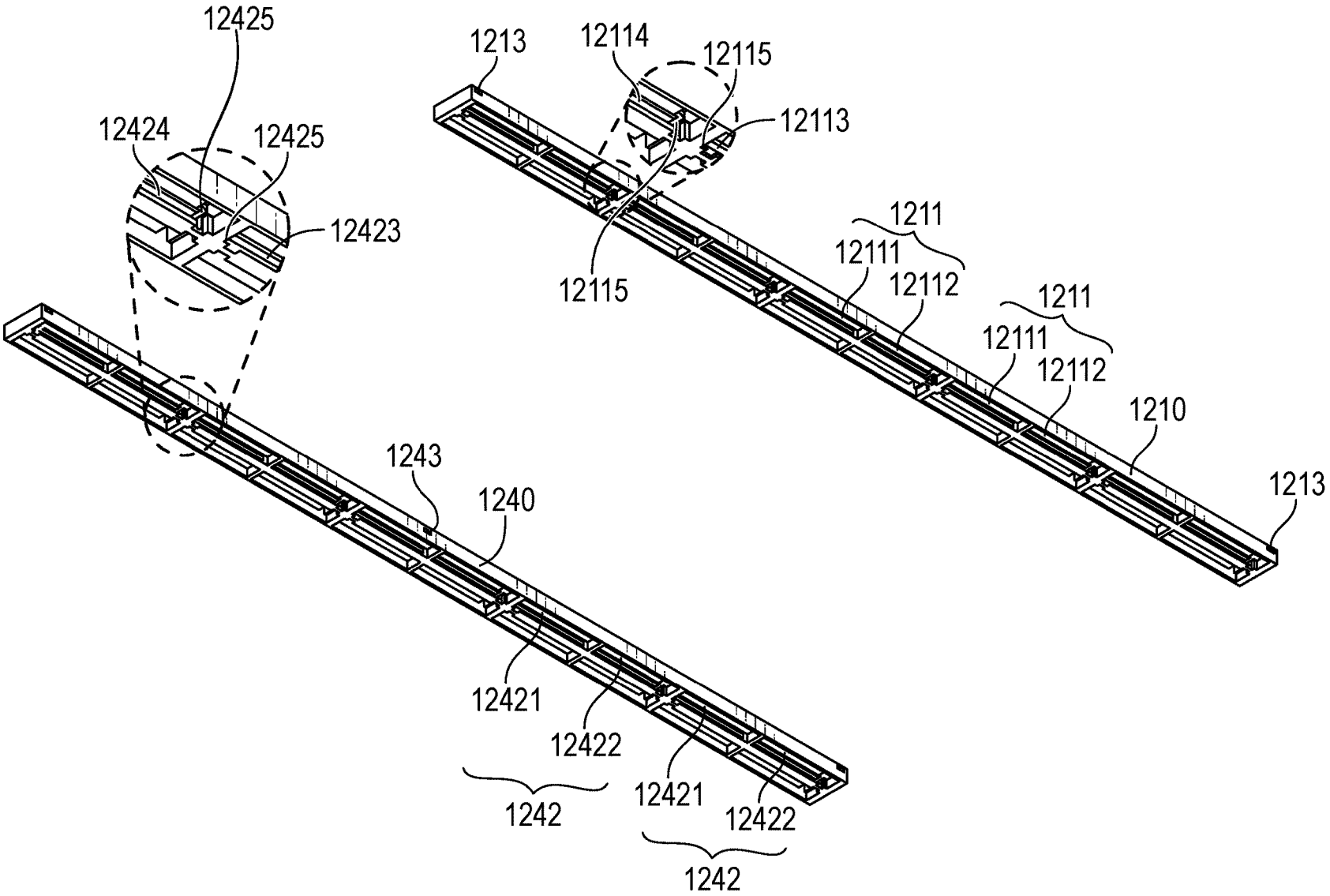
FIG. 5 demonstrates the inside mechanism of the upper beam and bottom beam of the first embodiment.

FIG. 5 shows the internal structure of the upper beam 1210 (or middle beam 1240) and lower beam 1250, because the structure on the top and bottom surface of the middle beam 1240 only duplicates the structure of the upper beam 1210 and lower beam 1250. In addition to the aforementioned structures, in each of the upper groove groups 1211 on the upper beam 1210, there is an upper fixing slot 12115 formed in inner top surfaces of the first upper grooves 12111 at one end away from the second upper grooves 12112 and inner top surfaces of the second upper grooves 12112 at one end away from the first upper grooves 12111 respectively for the first short rods 1220, the second short rods 1221, the first sliding rods 12201, and the second sliding rods 12211 to be fixed in the upper fixing slots 12115 to avoid sliding when assembled into a complete wall. And, in each of the second middle groove groups 1242 on the middle beam 1240, there is a middle fixing slot 12425 formed in inner top surfaces of the third middle grooves 12421 at one end away from the fourth middle grooves 12422 and inner top surfaces of the fourth middle grooves 12422 at one end away from the third middle grooves 12421 respectively for the third short rods 1222, the fourth short rods 1223, the third sliding rods 12221, and the fourth sliding rods 12231 to be fixed in the middle fixing slots 12425 to avoid sliding when assembled into a complete wall. Since the upper fixing slots 12115 and middle fixing slots 12425 are slightly deeper than the first upper grooves 12111, second upper grooves 12112, third middle grooves 12421, fourth middle grooves 12422, and thus can catch the first short rods 1220 to the fourth short bar 1223 in the fully expanded state.

At the ends of the upper beam 1210, there are two snap holes 1213 for the siding 1100. the upper mechanism of the lower beam 1250 is substantially similar to the lower mechanism of the upper beam 1210, with slots 1251 reserved for the stub 1220 in the folded state, and also with positions 1252 for fixing the bearings. there are also snap holes 1213 for the siding 1100 in its middle.

Figure 7:
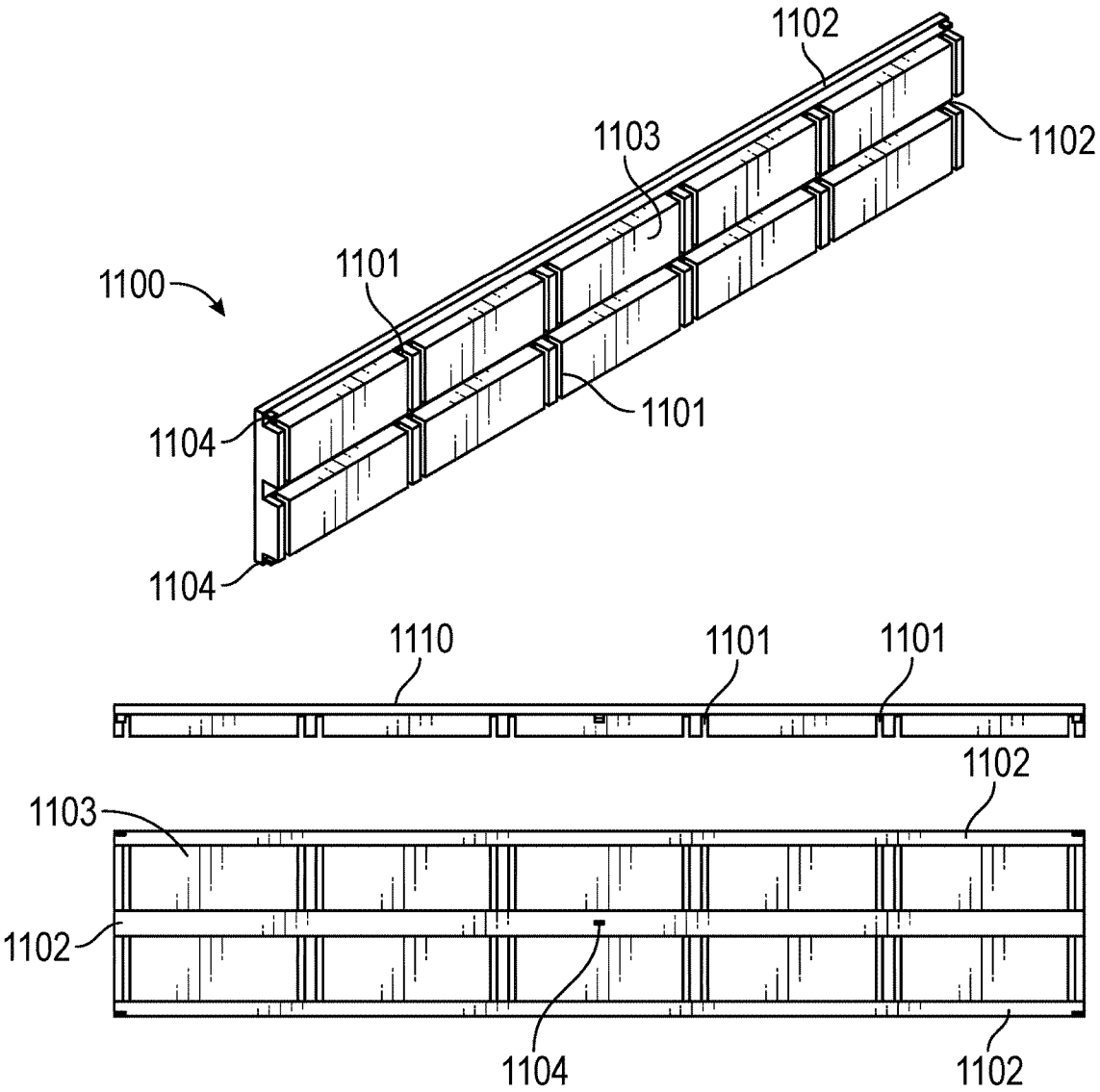
FIG. 7 shows a wall skin in the first embodiment.

The first embodiment of the wall skin 1100 is shown in detail in FIG. 7. One of the plates 1110 is the outer surface of the wall skin 1100, and the outside of the plate 1110 is exposed after the installation of the wall 1000 is completed. The wall skin 1100 is provided with a plurality of longitudinal grooves 1101 corresponding to the first short rods 1220, the second short rods 1221, the third short rods 1222, and the fourth short rods 1223. The wall skin 1100 is also provided with a plurality of transverse grooves 1102 corresponding to the upper beam 1210, the lower beam 1250, and the middle beams 1240. The wall skin 1100 is further provided with a plurality of fillers 1103 between the longitudinal grooves 1101 and the transverse grooves 1102. Through these structures, the wall skin 1100 can be combined with the wall frame 1200 more quickly. In addition, the wall skin 1100 is provided with a plurality of snaps 1104, and the upper beam 1210, the lower beam 1250, and the middle beams 1240 are provided with a plurality of snap holes 1213, 1243, 1253 correspondingly (as shown in FIGS. 3-5). These snap structures can help workers quickly combine or disassemble the wall skin 1100 and the wall frame 1200 to further reduce maintenance time or assembly time. In addition, some sound-insulating materials and/or fire-resistant materials may be added to the fillers 1103 to enhance the practicality of the present invention.

It should be noted that, in the first embodiment, the middle beam 1240 is only provided with one, but this is only an example. In other embodiments, like show in FIG. 8, a plurality of middle beams 1240 can be added between the upper beam 1210 and the lower beam 1250 to build the wall frame 1200. In those embodiments, when the amount of middle beams 1240 is over one, structure of the wall frame 1200 is that the upper beam 1210 is at the top, the lower beam 1250 is at the bottom, the middle beams 1240 are sandwiched in the middle, and the first short rods 1220, the second short rods 1221, the third short rods 1222, and the fourth short rods 1223 connect the middle beams 1240 to each other in the manner of connecting the upper beam 1210 and the middle beam 1240 and the manner of connecting the middle beam 1240 and the lower beam 1250. In other words, the first short rods 1220 and the second short rods 1221 can be used to connect any middle beam 1240 to the middle beam 1240 below it, in addition to connecting the upper beam 1210 and the middle beam 1240 adjacent to the upper beam 1210. Since the connection method is the same as the connection between the upper beam 1210 and middle beam 1240, it will not be repeated here. What's more, the third short rods 1222 and the fourth short rods 1223 can also be used to connect any middle beam 1240 and the middle beam 1240 above it, in addition to connecting the lower beam 1250 and the middle beam 1240 adjacent to the lower beam 1250. Since the connection method is the same as the connection between the lower beam 1250 and the middle beam 1240, it will not be repeated here.

Figure 8:
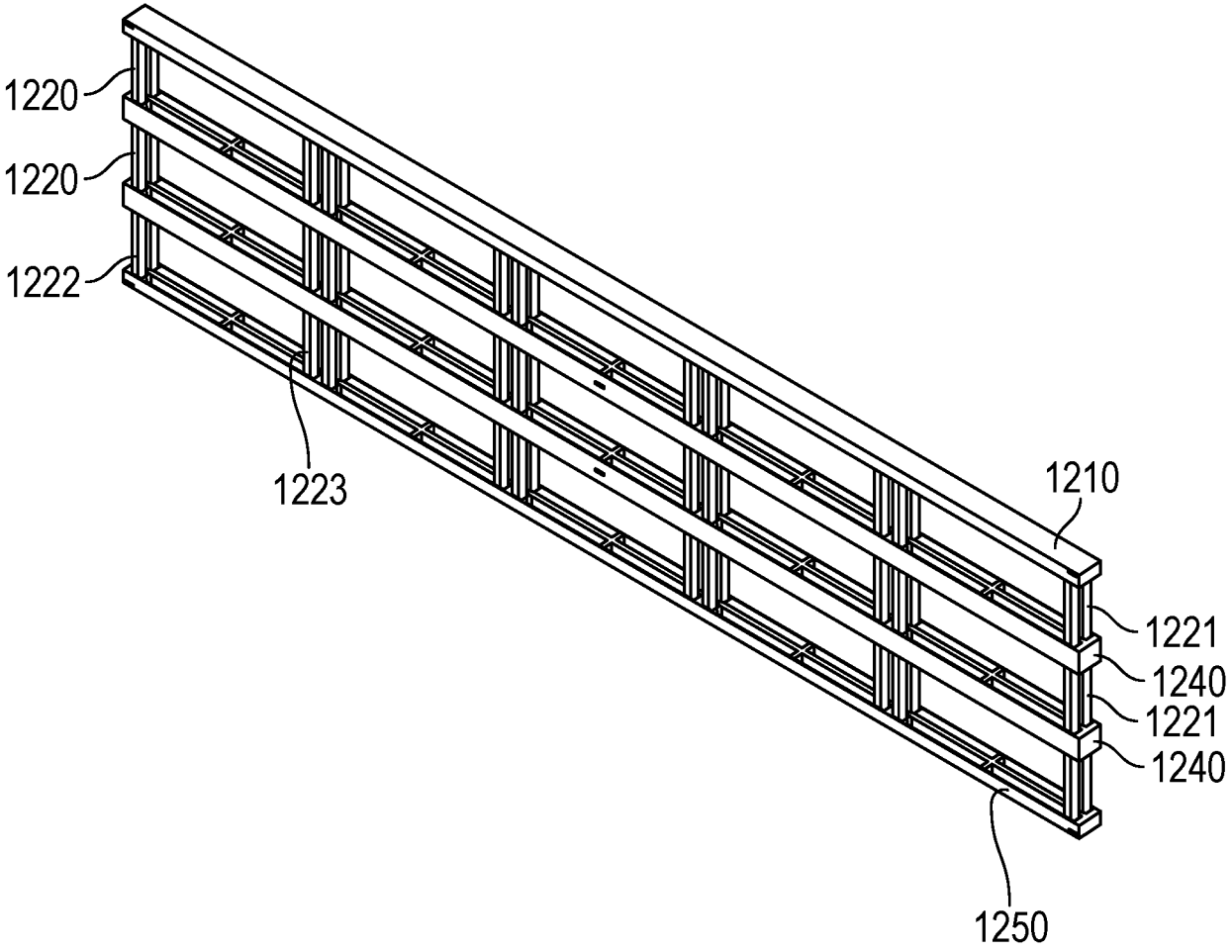
FIG. 8 illustrates another type of the wall frame of the first embodiment.
Figure 9:
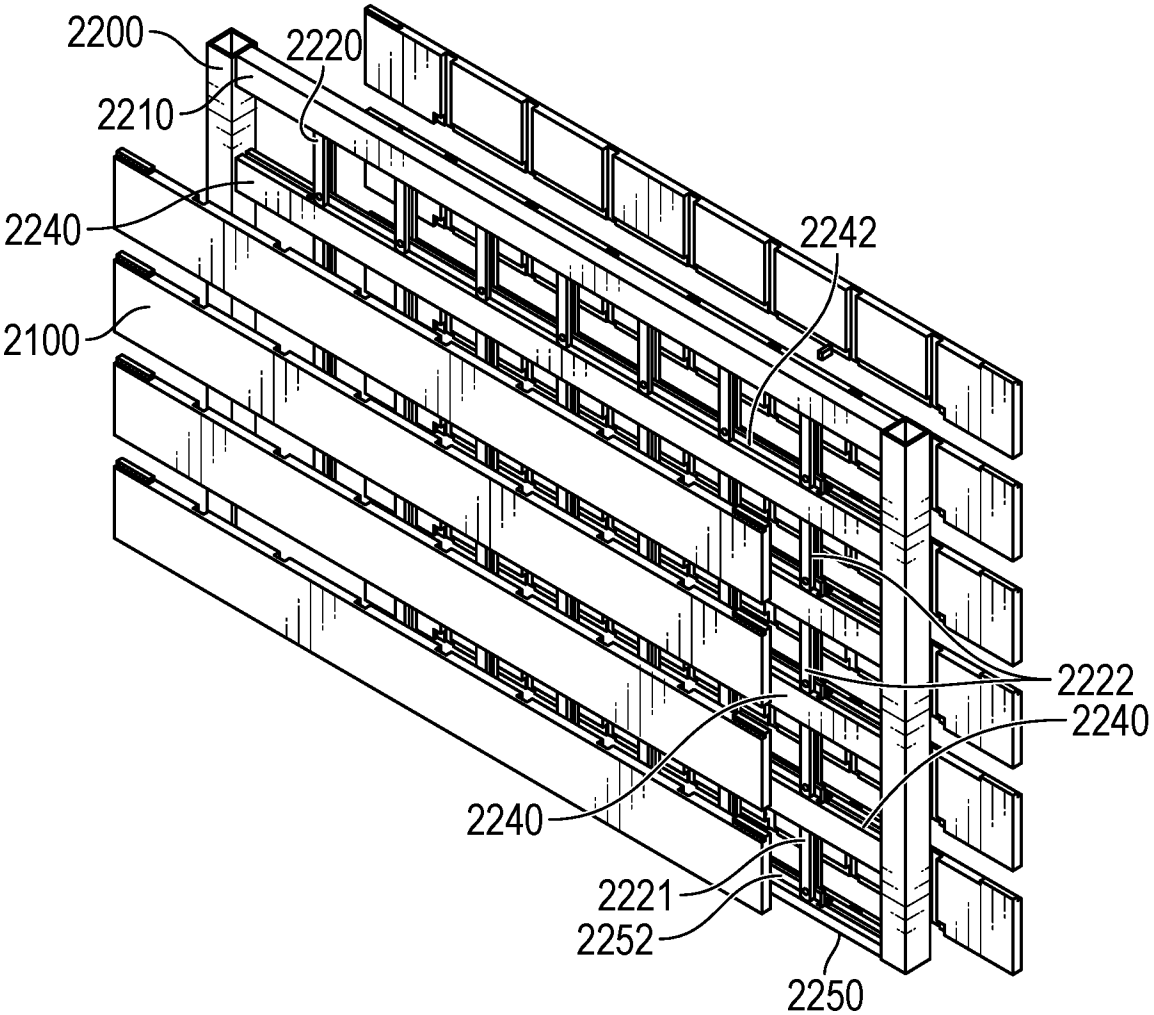
FIG. 9 illustrates the explosion view of a second embodiment of the assembled wall.
Figure 10:
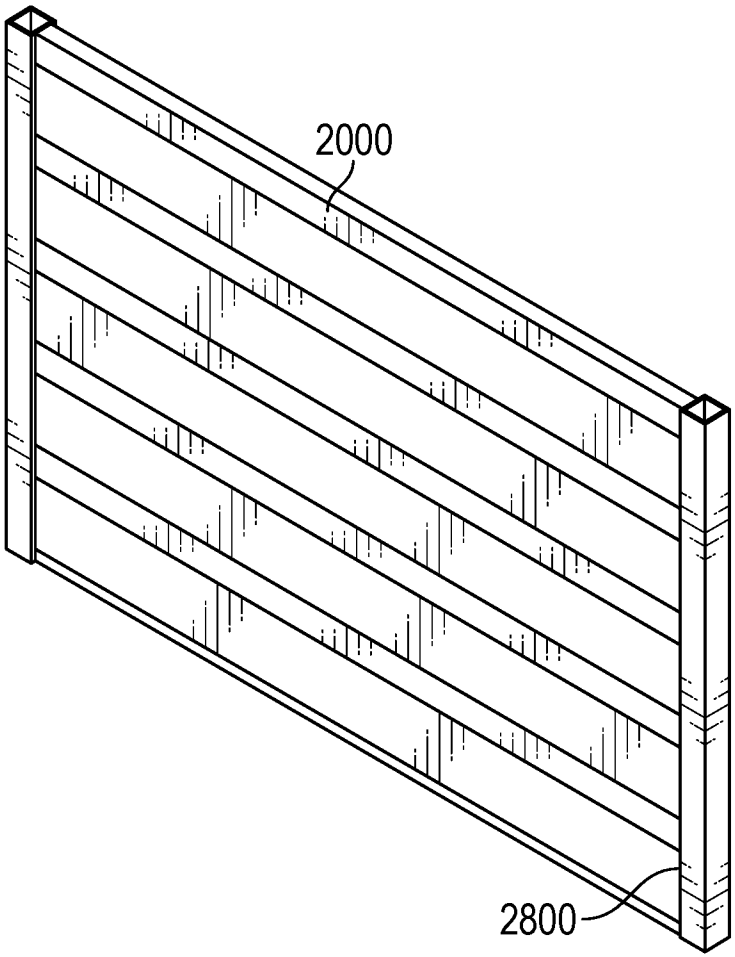
FIG. 10 illustrates the schematic view of a second embodiment of the assembled wall.

Please refer to FIGS. 9 & 10, they show an orthogonal view of the second embodiment of foldable and framed wall assembly 2000, which shows only one modular 2000, in reality, there may be more than one 2000 put together. FIG. 8 is an exploded view of the foldable and framed wall assembly 2000, whose main structure consists of wall skin 2100, middle beam 2240, upper beam 2210, and lower beam 2250. The entire foldable and framed wall assembly 2000 requires wall skin 2100 to be installed on both front and back sides of the wall frame 2200. The pillar 2800 was shown in the figure to show the fully-assembled model of the wall 2000.

In some embodiments, the wall frame 2200 may only contain an upper beam, a middle beam, and a lower beam. That is, the foldable and framed wall assembly 2000 comprising:

a wall frame 2200, comprising:

an upper beam 2210 with an upper deep groove 2211 at bottom;

a lower beam 2250, top of which is provided with a lower long groove 2251, and a lower slider 2252 is slidably arranged in the lower long groove 2251;

at least one middle beam 2240, top of which is provided with a middle long groove 2241, and a middle slider 2242 is slidably arranged in the middle long groove 2241, and bottom of the middle beam 2240 is provided with a middle deep groove 2243;

a plurality of upper short rods 2220, top end of which is pivotally connected to the upper deep groove 2211, and bottom end is pivotally connected to the middle slider 2242, and the upper short rods 2220 are arranged at intervals; and a plurality of lower short rods 2221, top end of which is pivotally connected to the middle deep groove 2243, and bottom end is pivotally connected to the lower slider 2252, and the lower short rods 2221 are arranged at intervals; and at least one wall skin 2100, which is detachably attached to the wall frame 2200 to fill up the space of the wall frame 2200 to form a complete wall.

Although the second embodiment has multiple middle beams 2240, the wall frame can also be assembled by only having one middle beam 2240 as described above, thus the present invention is not limited to the description above.

Figure 11:
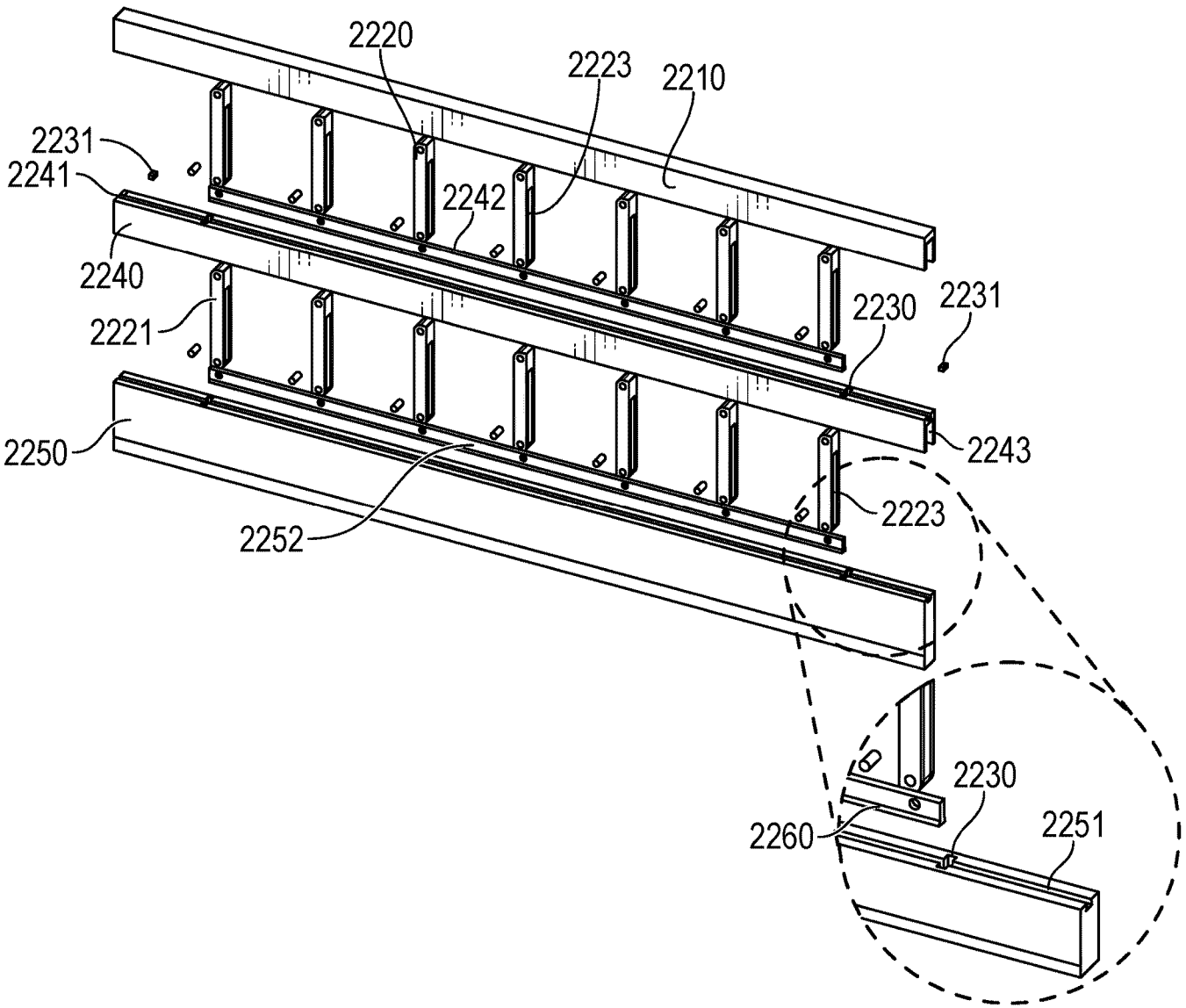
FIG. 11 shows the explosion view of the assembled frame in the second embodiment.
Figure 12:
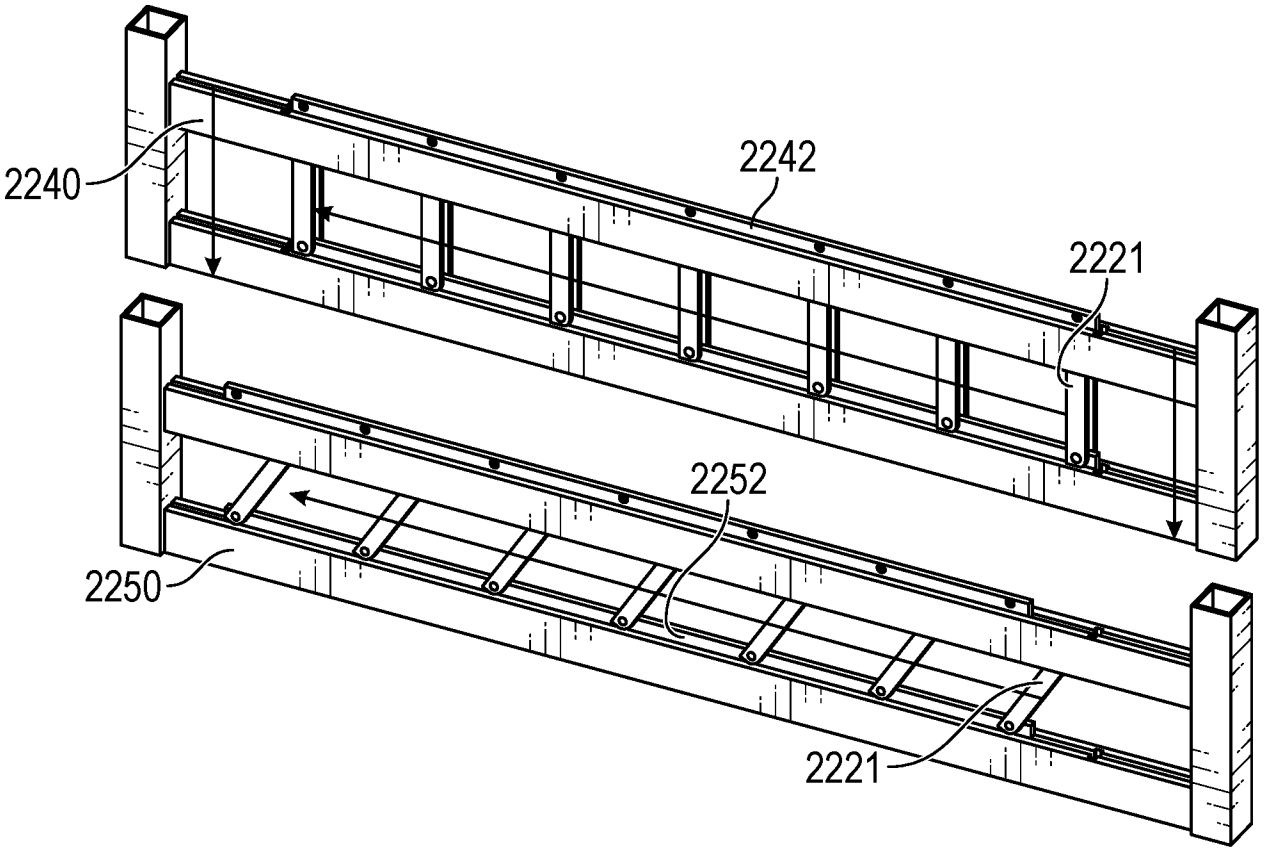
FIG. 12 shows the schematic view of the assembled frame and how to collapse frame in the second embodiment.

Please also refer to FIGS. 11 & 12, FIG. 11 shows how the wall frame 2200 is unfolded in the second embodiment. Only the structure of the middle beam 2240 is shown there because both the upper beam 2210 and the lower beam 2250 are repeating the structure of the upper and lower parts of the middle beam and already described above. In order to allow the middle slider 2242 to slide in the middle beam 2240, a middle long groove 2241 is cut in the upper part of the middle beam 2240. In this embodiment, the middle long groove 2241 is provided with two blocking grooves 2230 for movably placing a blocking member 2231 to block the sliding of the middle slider 2242. In addition, a middle deep groove 2243 is cut in the lower part of the middle beam 2240, the purpose of which is to allow middle short rods 2222 to be completely stowed in during the folding process. Tops of the middle short rods 2222 are pivotally connected to the middle deep groove 2243 in any of the middle beam 2240 that is not adjacent to the lower beam 2250, and bottom ends of the middle short rods 2222 are pivotally connected to the middle slider 2242 of the middle beam 2240 located below, and the middle short rods 2222 are arranged at intervals. There is a groove 2223 on one side of each of the middle short rods 2222, in order not to interfere with the middle slider 2242 in the folded state.

Furthermore, the lower long groove 2251 is also provided with two blocking grooves 2223 for movably placing a blocking member 2231 to block the sliding of the lower slider 2252. In addition, bottom of the middle slider 2242 and the lower slider 2252 are provided with a limiting member 2260, and the width of bottom of the limiting members 2260 is greater than that where the limiting members 2260 are connected to the middle slider 2242 and the lower slider 2252 (small at the top and large at the bottom) to limit the movement of the middle slider 2242 and the lower slider 2252 in the middle long groove 2241 and lower long groove 2251. The upper short rods 2220 and the lower short rods 2221 are also provided with a groove 2223 on one side so that the middle slider 2242 and the lower slider 2252 do not get caught when folded.

FIG. 12 shows the folding process of the wall frame 2200. After blocking member 2231 takes out from the blocking grooves 2223, top and bottom ends of the upper short rods

2220, top and bottom ends of the middle short rods 2222, and top and bottom ends of the lower short rods 2221 are rotated respectively in opposite directions to drive the middle slider 2242 and the lower slider 2252 to move, so that the upper short rods 2220, the middle short rods 2222, and the lower short rods 2221 are gradually inclined. That is, the upper short rods 2220, the middle short rods 2222, and the lower short rods 2221 are triggered to make the middle slider 2242 and the lower slider 2252 start sliding in the middle long groove 2241 and the lower long groove 2251, and then the upper beam 2210 and the middle beam 2240 are moved vertically downward and overlapped on the lower beam 2250. At this time, the upper short rods 2220, the middle short rods 2222, and the lower short rods 2221 are respectively placed in the upper deep groove 2211 and the middle deep groove 2243. Therefore, the folding process is completed.

Figure 13:
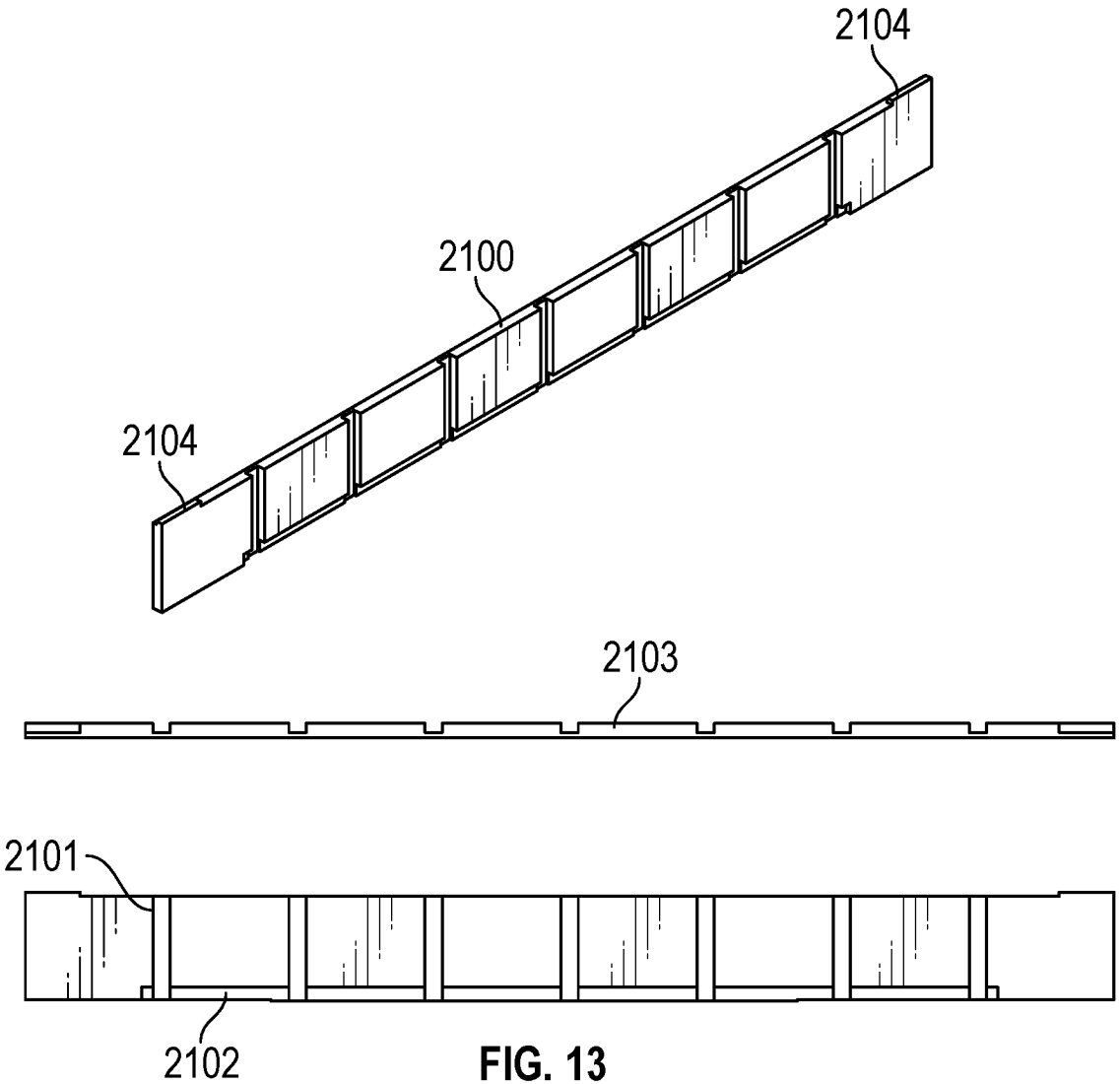
FIG. 13 shows a wall skin in the second embodiment.

Please refer to FIG. 13, it shows the wall skin 2100 of the second embodiment of the foldable and framed wall assembly 2000. In this embodiment, the wall skin 2100 is provided with a plurality of longitudinal grooves 2101 corresponding to the upper short rods 2220, the middle short rods 2222, and the lower short rods 2221, and the wall skin 2100 is also provided with a plurality of transverse grooves 2102 corresponding to the upper beam 2210, the lower beam 2250, and the middle beams 2240, and the wall skin 2100 is further provided with a plurality of fillers 2103 between the longitudinal grooves 2101 and the transverse grooves 2102. Through these structures, the wall skin 2100 can be combined with the wall frame 2200 more quickly. Furthermore, the top of the wall skin 2100 is provided with two protrusions 2104 for inserting into the upper deep groove 2211 and the middle deep groove 2243 so that the wall skin 2100 and the wall frame 2200 are combined with each other. These structures can help workers quickly combine or disassemble the wall skin 2100 and the wall frame 2200 to further reduce maintenance time or assembly time. In addition, some sound-insulating materials and/or fire-resistant materials may be added to the fillers 2103 to enhance the practicality of the present invention.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A foldable and framed wall assembly, comprising:

a wall frame, comprising:

an upper beam, bottom of which is provided with a plurality of upper groove groups, and each of the upper groove groups is provided with two first upper grooves and two second upper grooves, and adjacent sidewalls between the first upper grooves are opened to form a first upper sliding hole, and adjacent sidewalls between the second upper grooves are also opened to form a second upper sliding hole, and the first upper grooves are symmetrically arranged with the second upper grooves;

a lower beam, top of which is provided with a plurality of lower groove groups, and each of the lower groove groups is provided with two first lower grooves and two second lower grooves, and the first lower grooves are symmetrically arranged with the second lower grooves;

at least one middle beam, top of which is provided with a plurality of first middle groove groups, and each of the first middle groove groups is provided with two first middle grooves and two second middle grooves corresponding to the first upper grooves and the second upper grooves respectively, and the first middle grooves are symmetrically arranged with the second middle grooves; bottom of the middle beam is provided with a plurality of second middle groove groups, and each of the second middle groove groups is provided with two third middle grooves and two fourth middle grooves corresponding to the first lower grooves and the second lower grooves respectively, and adjacent sidewalls between the third middle grooves are opened to form a first middle sliding hole, and adjacent sidewalls between the fourth middle grooves are also opened to form a second middle sliding hole, and the third middle grooves are symmetrically arranged with the fourth middle grooves;

multiple pairs of first short rods, top ends of which are inserted into the first upper grooves and slide on the first upper sliding hole through a first sliding rod, and bottom ends of the pair of first short rods are connected with the first middle grooves through a first pivot, so that the bottom ends can rotate when the top ends slide;

multiple pairs of second short rods, top ends of which are inserted into the second upper grooves, and slide on the second upper sliding hole through a second sliding rod, and bottom ends of the pair of second short rods are connected with the second middle grooves through a second pivot, so that the bottom ends can rotate when the top ends slide;

multiple pairs of third short rods, top ends of which are inserted into the third middle grooves, and slide on the first middle sliding hole through a third sliding rod, and bottom ends of the pairs of third short rods are connected with the first lower grooves through a third pivot, so that the bottom ends can rotate when the top ends slide; and multiple pairs of fourth short rods, top ends of which are inserted into the fourth middle grooves, and slide on the second middle sliding hole through a fourth sliding rod, and bottom ends of the pairs of fourth short rods are connected with the second lower grooves through a fourth pivot, so that the bottom ends can rotate when the top ends slide; and at least one wall skin, which is detachably attached to the wall frame to fill up the space of the wall frame to form a complete wall;

wherein, when the wall skin is not connected with the wall frame, the top ends of the first short rods and the second short rods slide toward each other, and the bottom ends of the first short rods rotate clockwise relative to the first middle grooves, and the bottom ends of the second short rods rotate counterclockwise relative to the second middle grooves, so that the upper beam moves downward and overlaps on the middle beam; the top ends of the third short rods and the fourth short rods also slide toward each other, and the bottom ends of the third short rods rotate clockwise relative to the first lower grooves, and the bottom ends of the fourth short rods rotate counterclockwise relative to the second lower grooves, so that the middle beam moves downward and overlaps on the lower beam.

2. The foldable and framed wall assembly of claim 1, wherein, when the upper beam is overlapped on the middle beam, a portion of each of the first short rods is located in the first upper grooves, and the other portion is located in the first middle grooves, and a portion of each of the second short rods is located in the second upper grooves, and the other portion is located in the second middle grooves; when the middle beam is overlapped on the lower beam, a portion of each of the third short rods is located in the third middle grooves, and the other portion is located in the first lower grooves, and a portion of each of the fourth short rods is located in the fourth middle grooves, and the other portion is located in the second lower grooves.

3. The foldable and framed wall assembly of claim 2, wherein when the amount of middle beams is over one, structure of the wall frame is that the upper beam is at the top, the lower beam is at the bottom, the middle beams are sandwiched in the middle, and the first short rods, the second short rods, the third short rods, and the fourth short rods connect the middle beams to each other in the manner of connecting the upper beam and the middle beam and the manner of connecting the middle beam and the lower beam.

4. The foldable and framed wall assembly of claim 3, wherein, in each of the upper groove groups, there is an upper fixing slot formed in inner top surfaces of the first upper grooves at one end away from the second upper grooves and inner top surfaces of the second upper grooves at one end away from the first upper grooves respectively for the first short rods, the second short rods, the first sliding rods, and the second sliding rods to be fixed in the upper fixing slots to avoid sliding when assembled into a complete wall.

5. The foldable and framed wall assembly of claim 4, wherein, in each of the second middle groove groups, there is a middle fixing slot formed in inner top surfaces of the third middle grooves at one end away from the fourth middle grooves and inner top surfaces of the fourth middle grooves at one end away from the third middle grooves respectively for the third short rods, the fourth short rods, the third sliding rods, and the fourth sliding rods to be fixed in the middle fixing slots to avoid sliding when assembled into a complete wall.

6. The foldable and framed wall assembly of claim 5, wherein, the wall skin is provided with a plurality of longitudinal grooves corresponding to the first short rods, the second short rods, the third short rods, and the fourth short rods; the wall skin is also provided with a plurality of transverse grooves corresponding to the upper beam, the lower beam, and the middle beams; the wall skin is provided with a plurality of fillers between the longitudinal grooves and the transverse grooves.

7. The foldable and framed wall assembly of claim 6, wherein, the wall skin is provided with a plurality of snaps, and the upper beam, the lower beam, and the middle beams are provided with a plurality of snap holes correspondingly.

8. A foldable and framed wall assembly, comprising:

a wall frame, comprising:

an upper beam with an upper deep groove at bottom;

a lower beam, top of which is provided with a lower long groove, and a lower slider is slidably arranged in the lower long groove;

at least one middle beam, top of which is provided with a middle long groove, and a middle slider is slidably arranged in the middle long groove, and bottom of the middle beam is provided with a middle deep groove;

a plurality of upper short rods, top end of which is pivotally connected to the upper deep groove, and bottom end is pivotally connected to the middle slider, and the upper short rods are arranged at intervals; and a plurality of lower short rods, top end of which is pivotally connected to the middle deep groove, and bottom end is pivotally connected to the lower slider, and the lower short rods are arranged at intervals; and at least one wall skin, which is detachably attached to the wall frame to fill up the space of the wall frame to form a complete wall;

wherein, when the wall skin is not connected with the wall frame, top and bottom ends of the upper short rods, and top and bottom ends of the lower short rods are rotated respectively in opposite directions to drive the middle slider and the lower slider to move, so that the upper short rods and the lower short rods are gradually inclined, and then the upper beam and the middle beam are moved vertically downward and overlapped on the lower beam; at this time, the upper short rods and the lower short rods are respectively placed in the upper deep groove and the middle deep groove.

9. The foldable and framed wall assembly of claim 8, wherein, when the amount of middle beams is over one, the upper short rods connect the upper beam with the middle beam adjacent to the upper beam, and the lower short rods connect the lower beam with the middle beam adjacent to the lower beam; the wall frame has a plurality of middle short rods, tops of the middle short rods are pivotally connected to the deep groove in any of the middle beam that is not adjacent to the lower beam, and bottom ends of the middle short rods are pivotally connected to the middle slider of the middle beam located below, and the middle short rods are arranged at intervals.

10. The foldable and framed wall assembly of claim 9, wherein, the middle long groove and the lower long groove are each provided with two blocking grooves for movably placing a blocking member to block the sliding of the middle slider and the lower slider.

11. The foldable and framed wall assembly of claim 10, wherein, bottom of the middle slider and the lower slider are provided with a limiting member.

12. The foldable and framed wall assembly of claim 11, wherein, width of bottom of the limiting members is greater than that where the limiting members are connected to the middle slider and the lower slider.

13. The foldable and framed wall assembly of claim 12, wherein, the upper short rods, the middle short rods, and the lower short rods are provided with a groove on one side so that the middle slider and the lower slider do not get caught when folded.

14. The foldable and framed wall assembly of claim 13, wherein, the wall skin is provided with a plurality of longitudinal grooves corresponding to the upper short rods, the middle short rods and the lower short rods, and the wall skin is also provided with a plurality of transverse grooves corresponding to the upper beam, the lower beam, and the middle beams, and the wall skin is further provided with a plurality of fillers between the longitudinal grooves and the transverse grooves.

15. The foldable and framed wall assembly of claim 14, wherein, top of the wall skin is provided with two protrusions for inserting into the upper deep groove and the middle deep groove so that the wall skin and the wall frame are combined with each other.

* * * * *